United States Patent [19]

Campbell

[11] 4,373,867

[45] Feb. 15, 1983

[54] PRESSURE CHARGED AIRLIFT PUMP

[75] Inventor: Gene K. Campbell, Las Vegas, Nev.

[73] Assignee: The United States of America as represented by the United States Department of Energy, Washington, D.C.

[21] Appl. No.: 178,653

[22] Filed: Aug. 15, 1980

[51] Int. Cl.[3] ..... F04B 23/08; F04B 45/06; F04F 1/20

[52] U.S. Cl. ..... 417/90; 417/393; 417/478

[58] Field of Search ..... 417/90, 91, 393, 478

[56] References Cited

U.S. PATENT DOCUMENTS

| | | | |
|---|---|---|---|
| 2,016,433 | 10/1935 | Humason . | |
| 2,339,920 | 1/1944 | Eddins | 417/91 |
| 2,423,111 | 7/1947 | O'Leary | 417/91 |
| 2,693,760 | 11/1954 | Miller . | |
| 2,720,836 | 10/1955 | Warren et al. | 417/91 |
| 3,123,007 | 3/1964 | Orr . | |
| 3,175,501 | 3/1965 | Carle . | |
| 3,551,076 | 12/1970 | Wilson | 417/478 X |
| 3,672,795 | 6/1972 | Arutunoff et al. | 417/424 |
| 3,910,728 | 10/1975 | Sloan | 417/390 |
| 3,963,377 | 6/1976 | Elliott | 417/90 |
| 4,076,466 | 2/1978 | Swanson | 417/390 |

*Primary Examiner*—Richard E. Gluck

[57] ABSTRACT

A pumping system is described for pumping fluids, such as water with entrained mud and small rocks, out of underground cavities such as drilled wells, which can effectively remove fluids down to a level very close to the bottom of the cavity and which can operate solely by compressed air pumped down through the cavity. The system utilizes a subassembly having a pair of parallel conduit sections (44, 46) adapted to be connected onto the bottom of a drill string utilized for drilling the cavity, the drill string also having a pair of coaxially extending conduits. The subassembly includes an upper portion which has means for connection onto the drill string and terminates the first conduit of the drill string in a plenum (55). A compressed air-driven pump (62) is suspended from the upper portion. The pump sucks fluids from the bottom of the cavity and discharges them into the second conduit. Compressed air pumped down through the first conduit (46) to the plenum powers the compressed air-driven pump and aerates the fluid in the second conduit to lift it to the earth's surface.

3 Claims, 4 Drawing Figures

PRESSURE CHARGED AIRLIFT PUMP

BACKGROUND OF THE INVENTION

The removal of water from a hole drilled deep into the ground, can be accomplished by the use of an air lift incorporated in the drill bit. The drill string may include a plurality of concentric pipes, most generally two concentric pipes are utilized in an arrangement known as a "dual string." During the drilling operation, drilling mud is pumped down through either the space between the pipes to the drill bit and the mud and entrained bits of rock flow upwardly through the inner pipe, or vice versa. When pumping out water, compressed air can be pumped down one of these spaces to force water through a coupling at the drill bit into the other space, the compressed air being utilized to lift the water up to the surface of the earth. However, it is found that this procedure becomes ineffective when only a moderate level of water is left in the hole, such as when about 40 to 50 feet of water remains. This fluid can be removed by a bailer, which includes a bucket with a check valve added at the bottom, but this technique is cumbersome.

One technique for removing substantially all of the water from a deep well involves the use of an electrically powered pump. However, the use of electrically powered apparatus requires that a crew of electricians be utilized, instead of just the drill crew which is more familiar with mechanical apparatus. Also electrically operated motors at the bottom of a deep well are not highly reliable, since the motor and all electrical connections, as well as cables leading through the drill string to the motor, must be isolated from the water, and rock bits can cause damage to insulation.

One object of the present invention is to provide a relatively simple and reliable pumping apparatus which can remove fluid, such as water with entrained mud and rock bits, from the deepest portion of a well.

Another object is to provide a dewatering pump for use in a deep well, which normally can be operated by the same crew members utilized to drill the well, and who may be proficient in only mechanical and hydraulic technologies.

An additional object is to provide a simple and reliable pumping apparatus in the form of a self contained subassembly that can be readily attached to the bottom of the dual string which is utilized to drill the hole.

SUMMARY OF THE INVENTION

In accordance with the present invention, a compressed gas operated pumping apparatus subassembly is provided for removing fluid from an underground cavity, which is of a design that enables it to be attached directly to the drill pipe string utilized in drilling the cavity where that drill string includes at least two parallel extending conduits. The upper portion of the subassembly includes means for attachment onto the pipe string and means for terminating the end of the first conduit in a plenum. The apparatus includes a compressed gas operated pump which lifts the water with entrained mud and rock bits from the bottom of the hole and discharges it through a third conduit into the second conduit, preferably the inner pipe when a dual string is utilized. Compressed gas is pumped down the other pipe to the subassembly where it is directed from the plenum to the pump operator through a fourth conduit and to the bottom of the second conduit through fifth conduit means to aerate the discharge from the pump to facilitate the flow to the earth's surface.

Thus, the compressed air pumped down the first conduit is utilized in two ways, first as a direct lifting device to thrust water upwardly through the first conduit, and secondly as a pump-driving power source to operate a pump that delivers water from the bottom of the cavity to the second conduit. The air-driven pump can be of a simple but effective type which can pump only a limited head of water, such as a diaphragm operated suction pump, since the water need be pumped only a small height before it reaches the second conduit where the pressure head which can be pumped is only limited by the pressure of compressed air applied to the first conduit.

The novel features of the invention are set forth with particularity in the appended claims. The invention will best be understood from the following description when read in conjunction with the accompanying drawings.

FIG. 4 is a partial sectional view of a pumping apparatus constructed in accordance with another embodiment of the invention.

DESCRIPTION OF THE PREFERRED EMBODIMENTS

Figure 1:
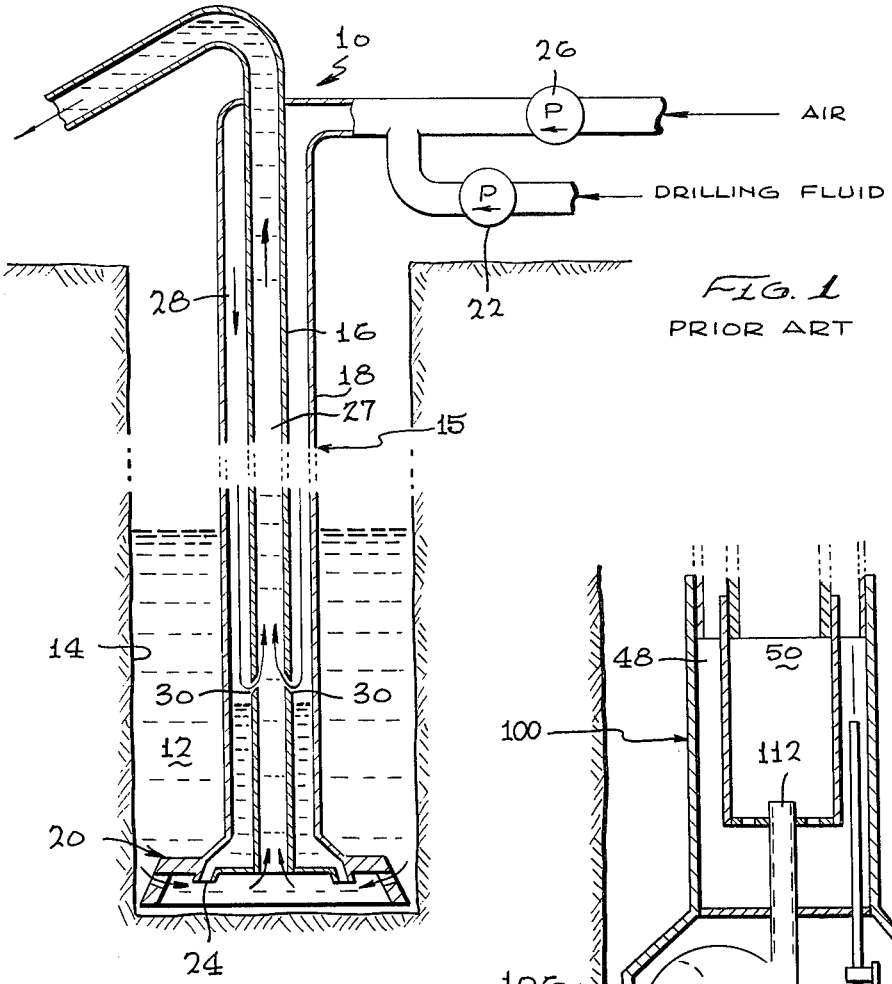
FIG. 1 PRIOR ART
FIG. 1 is a sectional view of a pumping apparatus, commonly encountered in the prior art.

FIG. 1 illustrates a typical prior art drill string installation 10 which may be utilized to drill cavity 14 deep within the ground. The drill string 15 includes inner and outer pipes 16, 18 which are concentric and which carry a large diameter drill bit 20 at their lower ends. During drilling of the hole in the ground, a drilling fluid such as a special drilling mud is moved through a pump 22 and down through the annular space 28 between the outer and inner pipes to openings 24 at the drill bit. At the same time, drilling mud with entrapped bits of rock flow upwardly through conduit 27 formed by inner pipe 16 and are disposed of at the surface of the ground. The upward flow of the drilling fluid with entrapped cuttings is facilitated by pumping air through another pump 26 to move the air downwardly through the space 28 between pipes, and through holes 30 in the inner pipe. This air flow aerates the column of fluid in the inner pipe 16, lifting it upwardly through the inner pipe. It is to be understood that FIG. 1 is illustrative only, and that drill string 15 would normally consist of a so-called dual string made up of a plurality of successive individual lengths, or sections, of inner and outer pipes 16 and 18 which are connected together by appropriate means. Drill bit 20 and holes 30 would normally be features of a drill bit subassembly connected onto the first, or lowermost section of the dual string.

The same drill string can be utilized to pump water 12 out of the cavity by pumping only air through the space 28 between the pipes. The compressed air can lift water through the inner pipe along a large height when highly compressed air is utilized, but is found ineffective in removing water from the deepest portion of the cavity. However, it can be appreciated that this approach to water removal is desirable in that it can utilize the same drill string and handling equipment employed to initially drill the hole, and employs substantially only mechanical equipment such as high pressure pumps and pipes which drilling crews are familiar with.

Figure 2:
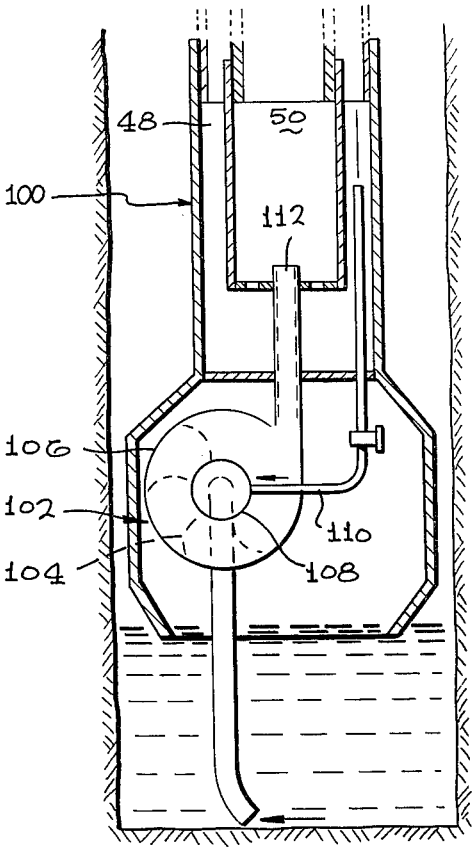
FIG. 2 is a sectional side view of a portion of a pumping apparatus constructed in accordance with the present invention.
Figure 3:
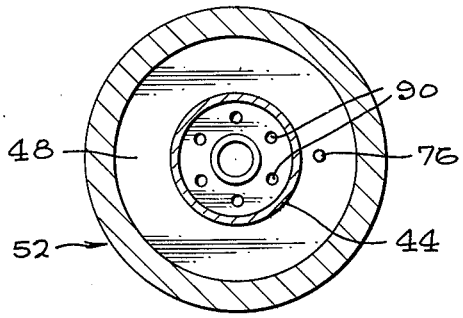
FIG. 3 is a view taken on the line 3—3 of FIG. 2.
Figure 2:
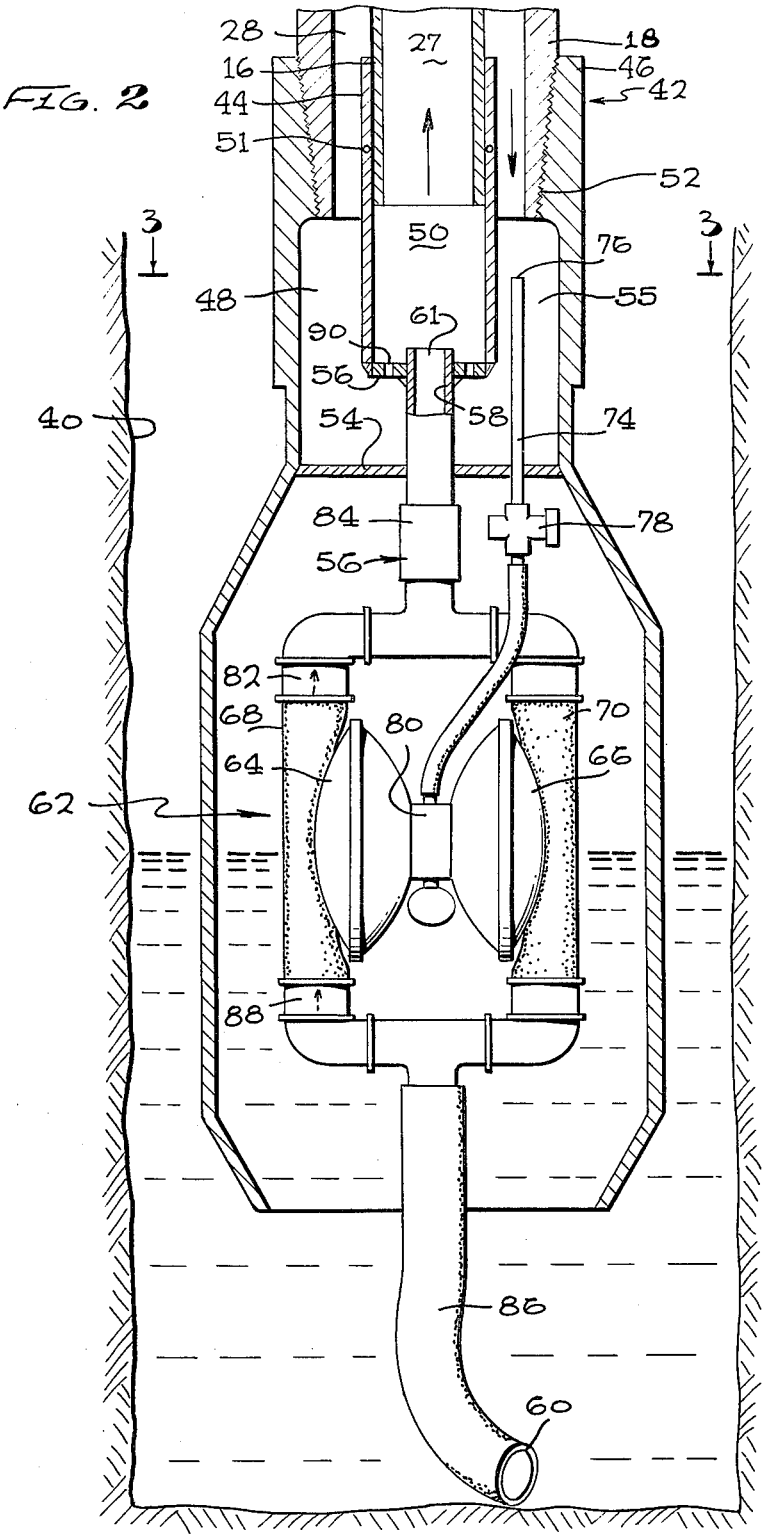

FIG. 2 illustrates a pumping apparatus which is effective in removing water down to the deepest portion of a cavity 40 in an effective manner, while still utilizing primarily the mechanical equipment which a drilling crew may already have on hand and which it is familiar with. The pumping apparatus subassembly 42 includes at its upper portion inner and outer pipe sections 44, 46 forming a pair of parallel conduits 48, 50 which are extensions of the conduits 27 and 28 of the drill string. The subassembly is connected onto the drill string by screw threads 52 between outer pipes 18 and 46. Inner pipe portion 44 is dimensioned to permit relative longitudinal movement of inner pipe 16, as may be occasioned by differential thermal expansion of the two drill strings, O-ring 51 providing a seal therebetween. The exact means provided for connecting the pumping subassembly onto the drill string would preferably be essentially identical to those utilized for attaching the drill bit onto the drill string. Plate 54 terminates outer conduit 48 in a plenum 55. Plate 56 terminates inner conduit 50 and suspended therefrom through pipe 58 is a compressed gas operated pump 62.

Pump 62 sucks water from the bottom of the cavity through suction hose 86 and discharges it into the bottom of inner conduit 50 through conduit 61 formed by pipe 58. The pump is operated by compressed gas delivered to pump operator 80 from plenum 55 through conduit 74. Plenum 55 is connected to inner conduit 50 through conduits 90 in plate 56.

It can be seen then, that the pumping apparatus subassembly 42 is powered in the same manner as the prior art apparatus shown in FIG. 1. Compressed gas, such as compressed air, pumped downwardly through the annular first conduit 48, causes the upward flow of water and compressed air through the second conduit 50 up to the surface of the earth. However, at least some of the fluid such as water to be pumped out of the cavity, is delivered up to the second conduit 50 by the auxiliary pump 62 and third conduit 61. The auxiliary pump 62 is of a type which is driven by compressed gas such as compressed air which it receives from the first conduit 48 through conduit 74. The pump 62 can be a relatively simple and efficient suction pump, even though a suction pump can generate only a limited heat of water, since the auxiliary pump has to raise the fluid only a limited height before it reaches the second conduit 50 where the compressed air injected therein through conduits 90 aerates the fluid and raises it to the surface of the earth. Since there are essentially no obstructions to the flow from the bottom of the cavity through pump 62 and then through inner conduit 50, mud and rock bits of moderate size will also be removed from the cavity along with the water.

The particular auxiliary pump 62 is of a type which includes a pair of inflatable chambers or diaphragms 64, 66 which can be inflated to squeeze a pair of easily squeezed hose sections 68, 70. Air utilized to inflate the diaphragms is obtained through an air line 74 with an inlet 76 lying in plenum 55 to receive compressed air therefrom, and which delivers the air through a pressure regulator 78 to an operator 80 which includes the control valving mechanism. The mechanism 80 alternately inflates and deflates the diaphragms 64, 66. As a diaphragm such as 64 is inflated to squeeze the corresponding hose section 68, fluid in the hose section 68 is expelled therefrom through a first check valve 82 and an auxiliary check valve 84, to flow through the supply conduit 61 into the second conduit 50. When the diaphragm 64 is deflated, fluid lying in a hose 86 can flow through another check valve 88 to again fill the hose section 68. The other side of the pump with the diaphragm 66, operates in a similar manner. As discussed above, water entering the second conduit 50 is lifted therealong by compressed air passing into the second conduit through holes 90 in the bottom plate thereof.

As in the prior art technique shown in FIG. 1, the pumping apparatus of FIG. 2 can utilize primarily the equipment and mechanical technology already available at a drilling site. The pumping subassembly 42 is preferably connected onto the first, or lowermost, section of the dual string in the same manner as the drill bit of FIG. 1 is connected thereto. As discussed above, the air pump which pumps compressed gas down through the drill string conduit 28 to provide circulation of the drilling fluid down first conduit 28 and up through the second conduit 27 during drilling operations, is the same pump that powers the compressed air-driven pumping subassembly 42 which lifts water from a deep underground location up through pump 62 to the second conduit and then to the earth's surface. In this way, the pumping apparatus avoids the need for an electrically driven auxiliary pump and the consequent need for power cables to run down along the cavity and the need for an electrical crew to connect and supervise operation of the electrical pump and power supply. By utilizing a compressed gas-driven auxiliary pump 62 with movable elements such as the inflatable diaphragms 64, 66, lifting of water from deep in the cavity up to the second conduit can be performed effectively and with a relatively small diameter pumping apparatus which can easily fit through even a relatively narrow cavity.

FIG. 4 illustrates another pumping apparatus 100 which is similar to that of FIG. 2, except that the apparatus 100 has an auxiliary pump 102 of another type. The auxiliary pump 102 includes turbine-like blades 104 as the movable fluid pumping element, the blades rotating within a housing 106 and being driven by a rotary air motor 108 which receives compressed gas through an air line 110. The turbine-like pump 102 can be effectively constructed to pump water through a relatively low pressure head, which is sufficient for this application since it must pump water through a supply conduit 112 that raises the fluid by only a limited height before it reaches the second conduit 50 through which the water is raised by compressed air.

Thus, the invention provides a pumping apparatus for removing fluids, including mud and rock bits, from an underground cavity which can utilize primarily the mechanical equipment and technology already available in drilling and excavation. This is accomplished by utilizing a compressed gas-driven pump to raise fluid therein by a limited height, from whence it can be raised to the earth's surface by another portion of the compressed gas pumped to the apparatus. The use of an auxiliary pump which need only pump fluid over a small pressure head, and which is powered by the same by compressed gas utilized to lift the fluid a much greater distance to the surface of the earth, enables a relatively simple but effective pumping apparatus to be utilized which can be readily connected to the bottom of the drill string utilized to drill the cavity.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A compressed gas operated pumping subassembly for attachment onto the end of a dual string drill pipe string having first and second parallel extending concentric conduits, said subassembly capable of removing water, mud and rock bits of moderate size from an underground cavity, said subassembly comprising:

(a) An upper portion having means for connecting the subassembly directly onto the end of the pipe string and extending said first and second conduits, terminating the end of said first conduit in a plenum;

(b) A compressed gas operated diaphragm pump suspended from said upper portion;

(c) A third conduit connecting the discharge of said pump with said second parallel extending conduit for fluid flow thereinto, said second and third conduits presenting essentially no obstruction to the flow of mud and rock bits of moderate size therethrough;

(d) A fourth conduit connecting said plenum to the pump operator for delivering pressurized gas thereto; and (e) Fifth conduit means connecting said plenum with said second parallel extending conduit whereby compressed gas delivered to said plenum through said first parallel extending conduit operates said pump and aerates the discharge from said pump in said second conduit thereby facilitating the flow of said discharge to the earth's surface.

2. The pumping subassembly of claim 1 wherein said second conduit is the inner one of said first and second coaxially extending pipes and said first conduit is the space formed between said pipes.

3. The pumping subassembly of claim 2 including check valve means which permit only upward flow from the suction side of said compressed gas operated pump, through said pump and said third conduit into said second conduit.

* * * * *